US009416494B2

(12) United States Patent
Lindsay et al.

(10) Patent No.: US 9,416,494 B2
(45) Date of Patent: Aug. 16, 2016

(54) MODIFIED CELLULOSIC FIBERS HAVING REDUCED HYDROGEN BONDING

(71) Applicant: Kimberly-Clark Worldwide, Inc., Neenah, WI (US)

(72) Inventors: Stephen Michael Lindsay, Appleton, WI (US); Michael Andrew Zawadzki, Appleton, WI (US); Jian Qin, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 196 days.

(21) Appl. No.: 14/359,833

(22) PCT Filed: Dec. 20, 2013

(86) PCT No.: PCT/US2013/076874

§ 371 (c)(1),
(2) Date: May 21, 2014

(87) PCT Pub. No.: WO2014/105689

PCT Pub. Date: Jul. 3, 2014

(65) Prior Publication Data

US 2016/0024717 A1 Jan. 28, 2016

Related U.S. Application Data

(63) Continuation-in-part of application No. 13/726,938, filed on Dec. 26, 2012, now Pat. No. 8,980,054.

(51) Int. Cl.

| | |
|---|---|
| ***D21H 11/20*** | (2006.01) |
| ***D21H 27/00*** | (2006.01) |
| ***D21C 9/00*** | (2006.01) |
| ***D21H 11/16*** | (2006.01) |
| ***D21C 1/04*** | (2006.01) |

(52) U.S. Cl.

CPC ..... *D21H 11/20* (2013.01); *D21C 1/04* (2013.01); *D21C 9/005* (2013.01); *D21H 11/16* (2013.01); *D21H 27/002* (2013.01)

(58) Field of Classification Search

USPC ..... 162/146, 157.6, 158, 161.1, 164.6, 182, 162/183, 185; 8/181, 189, 190

See application file for complete search history.

(56) References Cited

U.S. PATENT DOCUMENTS

| | | | | |
|---|---|---|---|---|
| 2,306,440 | A | 12/1942 | Winfrid et al. | |
| 2,524,399 | A | 10/1950 | Schoene et al. | |
| 2,892,674 | A | 6/1959 | Sause et al. | |
| 3,124,414 | A | 3/1964 | Dolmetsch | |
| 3,240,797 | A | 3/1966 | Gale | |
| 3,961,892 | A | 6/1976 | Bishop et al. | |
| 3,994,771 | A | 11/1976 | Morgan, Jr. et al. | |
| 4,035,146 | A | 7/1977 | Brenner et al. | |
| 4,166,001 | A | 8/1979 | Bicho et al. | |
| 4,186,238 | A | 1/1980 | Holst et al. | |
| 4,225,382 | A | 9/1980 | Kearney et al. | |
| 4,300,981 | A | 11/1981 | Carstens | |
| 4,372,815 | A | 2/1983 | Newkirk et al. | |
| 4,432,833 | A | 2/1984 | Breese | |
| 4,549,011 | A | 10/1985 | Herzberg et al. | |
| 5,776,394 | A | 7/1998 | Schrott et al. | |
| 5,882,356 | A | 3/1999 | Potter | |
| 5,935,383 | A | 8/1999 | Sun et al. | |
| 6,022,378 | A * | 2/2000 | Eibl | D01F 2/00 8/190 |
| 6,036,731 | A | 3/2000 | Scheibli et al. | |
| 6,241,933 | B1 * | 6/2001 | Koll | D06M 13/358 264/340 |
| 6,328,850 | B1 | 12/2001 | Phan et al. | |
| 7,867,361 | B2 | 1/2011 | Salaam et al. | |
| 8,177,859 | B2 | 5/2012 | Schmidt et al. | |
| 2002/0037410 | A1 | 3/2002 | Criegee et al. | |
| 2002/0096287 | A1 | 7/2002 | Jewell et al. | |
| 2002/0112830 | A1 | 8/2002 | Bakken et al. | |
| 2002/0195215 | A1 | 12/2002 | Holz et al. | |
| 2003/0111196 | A1 | 6/2003 | Hu | |
| 2003/0131960 | A1 | 7/2003 | McConnell et al. | |
| 2005/0006039 | A1 | 1/2005 | Farrington, Jr. et al. | |
| 2005/0011015 | A1 * | 1/2005 | Schmidt | D06M 13/292 8/183 |
| 2005/0241791 | A1 | 11/2005 | Wolkowicz et al. | |
| 2005/0252626 | A1 | 11/2005 | Chen et al. | |
| 2008/0014428 | A1 | 1/2008 | Vinson et al. | |
| 2009/0321238 | A1 * | 12/2009 | Nhan | D04H 1/42 200/5 A |

FOREIGN PATENT DOCUMENTS

| | | | |
|---|---|---|---|
| EP | 0404189 | A1 | 12/1990 |
| EP | 0 440 472 | A1 | 8/1991 |
| EP | 0 939 844 | B1 | 11/2005 |
| JP | 2007-308857 | A * | 11/2007 |
| WO | WO 85/04200 | A1 | 9/1985 |
| WO | WO 96/06223 | A1 | 2/1996 |
| WO | WO 98/24974 | A1 | 6/1998 |
| WO | WO 99/36620 | A1 | 7/1999 |
| WO | WO 01/23660 | A1 | 4/2001 |
| WO | WO 01/49924 | A2 * | 7/2001 |
| WO | WO 02/14606 | A2 | 2/2002 |
| WO | WO 2005/123699 | A1 | 12/2005 |
| WO | WO 2009/017288 | A1 | 2/2009 |
| ZA | 97/09287 | A | 5/1998 |

OTHER PUBLICATIONS

DERWENT Abstract of JP 2007/308857 A, (2008).*

* cited by examiner

*Primary Examiner* — Dennis Cordray

(74) *Attorney, Agent, or Firm* — Kimberly-Clark Worldwide, Inc.

(57) ABSTRACT

The present invention provides a modified cellulosic fiber having reduced hydrogen bonding capabilities. The modified fiber formed in accordance with the present invention may be useful in the production of tissue products having improved bulk and softness. More importantly, the modified fiber is adaptable to current tissue making processes and may be incorporated into a tissue product to improve bulk and softness without an unsatisfactory reduction in tensile.

20 Claims, No Drawings

MODIFIED CELLULOSIC FIBERS HAVING REDUCED HYDROGEN BONDING

RELATED APPLICATIONS

The present application is a national-phase entry, under 35 U.S.C. §371, of PCT Patent Application No. PCT/US2013/076874, filed on Dec. 20, 2013, which is a continuation-in-part application of, and claims priority to, U.S. patent application Ser. No. 13/726,938, filed on Dec. 26, 2012, all of which are incorporated herein by reference in a manner consistent with the present application.

BACKGROUND

In the manufacture of paper products, such as facial tissue, bath tissue, paper towels, dinner napkins, and the like, a wide variety of product properties are imparted to the final product through the use of chemical additives applied in the wet end of the tissue making process. Two of the most important attributes imparted to tissue through the use of wet end chemical additives are strength and softness. Specifically for softness, a chemical debonding agent is normally used. Such debonding agents are typically quaternary ammonium compounds containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and slough in the product. Indeed, while softness increases, it is at the expense of an increase in lint and slough in the tissue relative to an untreated control. It can also be shown that in a blended (non-layered) sheet the level of lint and slough is inversely proportional to the tensile strength of the sheet. Lint and slough can generally be defined as the tendency of the fibers in the paper web to be rubbed from the web when handled.

It is also broadly known in the art to use a multi-layered tissue structure to enhance the softness of the tissue sheet. In this embodiment, a thin layer of strong softwood fibers is used in the center layer to provide the necessary tensile strength for the product. The outer layers of such structures are composed of the shorter hardwood fibers, which may or may not contain a chemical debonder. A disadvantage to using layered structures is that while softness is increased the mechanism for such increase is believed due to an increase in the surface nap of the debonded, shorter fibers. As a consequence, such structures, while showing enhanced softness, do so with a trade-off in the level of lint and slough.

It is also broadly known in the art to concurrently add a chemical strength agent in the wet-end to counteract the negative effects of the debonding agents. In a blended sheet, the addition of such agents reduces lint and slough levels. However, such reduction is done at the expense of surface feel and overall softness and becomes primarily a function of sheet tensile strength. In a layered sheet, strength chemicals are added preferentially to the center layer. While this perhaps helps to give a sheet with an improved surface feel at a given tensile strength, such structures actually exhibit higher slough and lint at a given tensile strength, with the level of debonder in the outer layer being directly proportional to the increase in lint and slough.

There are additional disadvantages with using separate strength and softness chemical additives. Particularly relevant to lint and slough generation is the manner in which the softness additives distribute themselves upon the fibers. Bleached Kraft fibers typically contain only about 2-3 milliequivalents of anionic carboxyl groups per 100 grams of fiber. When the cationic debonder is added to the fibers, even in a perfectly mixed system where the debonder will distribute in a true normal distribution, some portion of the fibers will be completely debonded. These fibers have very little affinity for other fibers in the web and therefore are easily lost from the surface when the web is subjected to an abrading force.

Therefore there is a need for a means of reducing lint and slough in soft tissues while maintaining softness and strength.

SUMMARY

It has now been surprisingly discovered the sheet bulk of a tissue web may be increased, with only minimal degradation in tensile strength, by forming the web with at least a portion of cellulosic fiber that has been reacted with cellulosic reactive agent and more preferably a water soluble cellulosic reactive agent having the general formula (I) or (II). Reacting cellulosic fibers in this manner results in a modified fiber having fewer hydroxyl groups available to participate in hydrogen bonding when the web is formed. The reduced hydrogen bonding results in a bulkier web that is also softer and less stiff.

Accordingly, in one embodiment the present invention provides a method of preparing a modified cellulosic fiber comprising the step of reacting a cellulosic fiber with a reagent having the general formula (I) and salts thereof:

(Formula I)

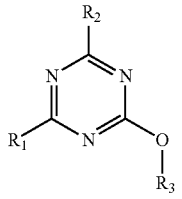

where $R_1$ and $R_2$ equal halogen, such as Cl, a quaternary ammonium group or an activated alkene and $R_3$ equals hydrogen or a metal cation, such as a sodium cation. Suitable quaternary ammonium groups include, for example, 4-m-carboxypyridinium and pyridinium. Suitable activated alkenes include, for example, alkenes having the general formula —NH—$C_6H_4$—$SO_2CH_2CH_2L$, where L is a leaving group selected from the group consisting of a halogen, —$OSO_3H$, —$SSO_3H$, —$OPO_3H$ and salts thereof.

In still other embodiments the treated fiber may be created by reacting cellulosic fiber with a reagent having the general formula (II):

(Formula II)

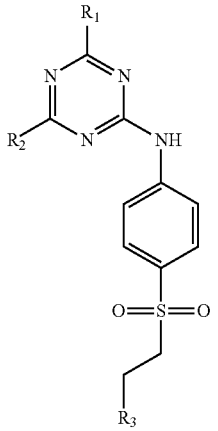

where $R_1$ equals F, Cl, Br, I or —OH, $R_2$ equals F, Cl, Br, I or —OH and $R_3$ equals —$OSO_3^-$ and salts thereof, —$SSO_3^-$ and salts thereof, phosphoric acid and salts thereof, or a halide.

In one embodiment reaction of the fiber with one of the foregoing reagents is carried out in the presence of a caustic agent, followed by washing the cellulosic fiber with water or the like to yield a treated fiber. The treated fiber may then be used to form a multi-layered tissue web from the treated cellulosic fiber by selectively incorporating the treated fiber in only one layer of the multi-layered tissue web, wherein the tissue web has a basis weight greater than about 10 grams per square meter (gsm), such as from about 10 to about 50 gsm and a sheet bulk greater than about 5 cc/g, such as from about 10 to about 20 cc/g.

In another embodiment the present invention provides a multi-layered tissue web comprising a first, second and third layer, where the second layer comprises modified wood pulp fibers having a nitrogen content greater than about 0.2 weight percent, and the first and third layers comprise untreated conventional cellulosic fibers, where the tissue web has a basis weight from about 10 to about 60 gsm and a sheet bulk greater than about 10 cc/g. In a particularly preferred embodiment the first and third layers are substantially free of modified wood pulp fibers.

In still other embodiments the present invention provides a multi-layered tissue web comprising a first, second and third layer, where the second layer comprises modified wood pulp fibers having a sulfur content greater than about 0.5 weight percent, and the first and third layers comprise untreated conventional cellulosic fibers, where the tissue web has a basis weight from about 10 to about 60 gsm and a sheet bulk greater than about 10 cc/g.

Other features and aspects of the present invention are discussed in greater detail below.

DEFINITIONS

As used herein the term "modified fiber" refers to any cellulosic fibrous material that has been reacted with a cellulosic reactive reagent selected from either a cyanuric halide having the general Formula (I) or a vinyl sulfone having the general Formula (II).

As used herein, the term "geometric mean tensile" (GMT) refers to the square root of the product of the machine direction tensile and the cross-machine direction tensile of the web, which are determined as described in the Test Method section.

As used herein, the term "tissue product" refers to products made from tissue webs and includes, bath tissues, facial tissues, paper towels, industrial wipers, foodservice wipers, napkins, medical pads, and other similar products.

As used herein, the terms "tissue web" and "tissue sheet" refer to a fibrous sheet material suitable for use as a tissue product.

As used herein, the term "caliper" is the representative thickness of a single sheet measured with using a TMI precision micrometer 49-62 (Testing Machines, Inc., New Castle, Del.). The micrometer has a load of 50.4 kilo-Pascals, a pressure foot area of 200 square millimeters, a pressure foot diameter of 16 millimeters, a dwell time of 3 seconds and a lowering rate of 0.8 millimeters per second. Caliper may be expressed in mils (0.001 inches) or microns.

As used herein the term "bulk" refers to the sheet bulk, which is calculated as the quotient of the caliper expressed in microns, divided by the basis weight, expressed in grams per square meter (gsm). The resulting Sheet Bulk is expressed in cubic centimeters per gram.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

DETAILED DESCRIPTION

The present invention provides a modified cellulosic fiber having reduced hydrogen bonding capabilities. The modified fiber formed in accordance with the present invention may be useful in the production of tissue products having improved bulk and softness. More importantly, the modified fiber is adaptable to current tissue making processes and may be incorporated into a tissue product to improve bulk and softness without an unsatisfactory reduction in tensile. The cellulosic fiber formed in accordance with the invention is modified cellulosic fiber that has been reacted with a cellulosic reactive reagent selected from reagents having the general formula (I) or (II). A decreased ability to hydrogen bond is imparted to the cellulosic fiber through reaction of the cellulosic fiber hydroxyl functional groups with the cellulosic reactive reagent, which impedes the hydroxyl functional groups from participating in hydrogen bonding with one. Preferably the number of hydroxyl groups reacted on each cellulosic fiber are sufficient to impede hydrogen bonding to a degree sufficient to enhance bulk and softness, but not so significant so as to negatively affect tensile strength. For example, preferably the modified cellulosic fiber increases sheet bulk by at least about 25 percent, such as from about 25 to about 100 percent, while only decreasing the tissue product's tensile index by less than about 25 percent, and more preferably by less than about 20 percent.

Wood pulp fibers are a preferred starting material for preparing the modified cellulosic fibers of the invention. Wood pulp fibers may be formed by a variety of pulping processes, such as kraft pulp, sulfite pulp, thermomechanical pulp, and the like. Further, the wood fibers may be any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, eucalyptus, maple, birch, aspen, and the like. In certain instances, eucalyptus fibers may be particularly desired to increase the softness of the web. Eucalyptus fibers can also enhance the brightness, increase the opacity, and change the pore structure of the tissue product to increase its wicking ability. Moreover, if desired, secondary fibers obtained from recycled materials may be used, such as fiber pulp from sources such as, for example, newsprint, reclaimed paperboard, and office waste.

In a particularly preferred embodiment hardwood pulp fibers modified with a cellulosic reactive reagent selected from either a cyanuric halide or a vinyl sulfone are utilized in the formation of tissue products to enhance their bulk and softness. In one particular embodiment, water soluble cyanuric halide modified hardwood pulp fibers, and more particularly modified eucalyptus kraft pulp fibers, are incorporated into a multi-layered web having a first layer comprising a blend of modified and unmodified hardwood kraft fibers and a second layer comprising softwood fiber. In such embodiments the modified fiber may be added to the first layer, such that the first layer comprises greater than about 2 percent, by weight of the layer, modified fiber, such as from about 2 to about 40 percent and more preferably from about 5 to about 30 percent.

The chemical composition of the modified fiber of the invention depends, in part, on the extent of processing of the cellulosic fiber from which the modified fiber is derived. In general, the modified fiber of the invention is derived from a fiber that has been subjected to a pulping process (i.e., a pulp fiber). Pulp fibers are produced by pulping processes that seek to separate cellulose from lignin and hemicellulose leaving the cellulose in fiber form. The amount of lignin and hemicellulose remaining in a pulp fiber after pulping will depend on the nature and extent of the pulping process. Thus, in certain embodiments the invention provides a modified fiber comprising lignin, cellulose, hemicellulose and a covalently bonded cyanuric halide.

Generally after reaction of the cellulosic reactive reagent and the pulp hydroxyl functional groups unreacted reagent is removed by washing. After washing, the extent of reaction between the pulp hydroxyl function groups and the cellulosic reactive reagent may be assessed by nitrogen elemental analysis in the case of a cyanuric halide reagent, with higher amounts of nitrogen indicating a greater extent of reaction. Accordingly, in one embodiment the modified fiber has a nitrogen content from about 0.05 to about 5 weight percent and more preferably from about 0.1 to about 3 weight percent.

In one embodiment the modified fiber comprises a cellulosic fiber that has been reacted with a halogen atom attached to a polyazine ring, for example fluorine, chlorine or bromine atoms attached to a pyridazine, pyrimidine or symtriazine ring. One preferred type of cyanuric halide reagent contains an aromatic ring having two reactive halide functional groups attached thereto such as that having the general formula (I):

(Formula I)

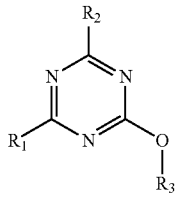

where $R_1$ and $R_2$ equal halogen, such as Cl, a quaternary ammonium group or an activated alkene and $R_3$ equals hydrogen or a metal cation, such as a sodium cation. Suitable quaternary ammonium groups include, for example, 4-m-carboxypyridinium and pyridinium. Suitable activated alkenes include, for example, alkenes having the general formula —NH—$C_6H_4$—$SO_2CH_2CH_2L$, where L is a leaving group selected from the group consisting of a halogen, —$OSO_3H$, —$SSO_3H$, —$OPO_3H$ and salts thereof.

In still other embodiments the treated fiber may be created by reacting cellulosic fiber with a reagent having the general formula (II):

(Formula II)

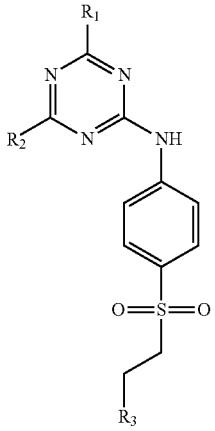

where $R_1$ equals F, Cl, Br, I or —OH, $R_2$ equals F, Cl, Br, I or —OH and $R_3$ equals —$OSO_3^-$ and salts thereof, —$SSO_3^-$ and salts thereof, phosphoric acid and salts thereof, or a halide.

Preferably the cellulosic reactive reagents have a water solubility of greater than about 5 mg/mL and more preferably greater than about 10 mg/mL and still more preferably greater than about 100 mg/mL, when measured at 60° C. and a pH greater than about 8. The water solubility of the reagent provides the advantage of simplifying the modification process, reducing costs and improving reaction yields of modified fibers.

Reaction with a water soluble cellulosic reactive reagent, compared to a water insoluble reagent such as 2,4,6-trichlorotriazine, provides the additional benefit of reducing the degree of crosslinking between cellulosic fibers. For example, 2-{4-[(dichloro-1,3,5-triazin-2-yl)amino]benzene sulfonyl}ethoxy)sulfonate is less reactive with cellulosic fibers than 2,4,6-trichlorotriazine because the most reactive chloride group has been substituted with amino ethane sulfonic acid to increase water solubility. The reduced reactivity and reduced number of halide functional groups results in less fiber crosslinking, which yields a modified fiber that is less stiff and more susceptible to processing, such as by refining.

Any suitable process may be used to generate or place the cellulosic reactive reagents on the cellulosic fibers, which is generally referred to herein as "modification." Possible modification processes include any synthetic method(s) which may be used to associate the cellulosic reactive reagent with the cellulosic fibers. More generally, the modification step may use any process or combination of processes which promote or cause the generation of a modified cellulosic fiber. For example, in certain embodiments the cellulosic fiber is first reacted with a cellulosic reactive reagent followed by alkaline treatment and then washing to remove excess alkali and unreacted reagent. In addition to alkali treatment, the cellulosic fiber may also be subjected to swelling. Alkali treatment and swelling may be provided by separate agents, or the same agent.

In a particularly preferred embodiment modification is carried out by alkali treatment to generate anionic groups, such as carboxyl, sulfate, sulfonate, phosphonate, and/or phosphate on the cellulosic fiber. Alkali treatment may be carried out before, after or coincidental to reaction with the cellulosic reactive reagent. Anionic groups are preferably generated under alkaline conditions, which in a preferred embodiment, is obtained by using sodium hydroxide. In other embodiments the alkaline agent is selected from hydroxide salts, carbonate salts and alkaline phosphate salts. In still other embodiments the alkaline agent may be selected from alkali metal or alkaline earth metal oxides or hydroxides; alkali silicates; alkali aluminates; alkali carbonates; amines, including aliphatic hydrocarbon amines, especially tertiary amines; ammonium hydroxide; tetramethyl ammonium hydroxide; lithium chloride; N-methyl morpholine N-oxide; and the like.

In addition to the generation of anionic groups by the addition of an alkaline agent, swelling agents may be added to increase access for modification. Interfibrillar and intercrystalline swelling agents are preferred, particularly swelling agents used at levels which give interfibrillar swelling, such as sodium hydroxide at an appropriately low concentration to avoid negatively affecting the rheological performance of the fiber.

Either prior to or after alkali treatment, the cellulosic fiber is reacted with a cellulosic reactive reagent to form a modified fiber. The amount of reagent will vary depending on the type of cellulosic fiber, the desired degree of modification and the desired physical properties of the tissue web formed with modified fibers. In certain embodiments the mass ratio of cellulosic fiber to reagent is from about 5:0.05 to about 2:1, more preferably from about 5:0.1 to about 4:1, such that the weight percentage of reagent, based upon the cellulosic fiber is from about 1 to about 50 percent and more preferably from about 2 to about 25 percent.

Further, modification may be carried out at a variety of fiber consistencies. For example, in one embodiment modification is carried out at a fiber consistency greater than about 5 percent solids, more preferably greater than about 10 percent solids, such as from about 10 to about 50 percent solids. In those embodiments where the cellulosic reactive reagent is mixed with the cellulosic fiber prior to alkali treatment it is particularly preferred that modification be carried out at a fiber consistency greater than about 10 percent, such as from about 10 to about 30 percent, so as to limit hydrolysis of the reagent.

Preferably the reaction of reagent and cellulosic fibers is carried out in an aqueous-alkaline solution having a pH value greater than about seven, more preferably greater than nine and more preferably greater than about ten. More preferably the aqueous-alkaline solution does not include an organic solvent and the cellulosic reactive reagent is not dissolved in an organic solvent prior to addition to the aqueous-alkaline solution.

The reaction time and temperature should be sufficient for the degree of modification, measured as the weight percent of nitrogen present in the fiber, where the reagent is a water soluble halide, is at least about 0.05 weight percent, such as from about 0.05 to about 5 weight percent, and more preferably from about 0.1 to about 3 weight percent. Accordingly, in certain embodiments, the treatment according to the invention can be carried at a temperature from about 0 about 40° C. The usual treatment times at 20° C. are from 30 minutes to 24 hours, more preferably from about 30 minutes to 10 hours, and more preferably from about 40 minutes to 5 hours.

As noted previously, the degree of modification may be measured by elemental analysis of the reacted cellulosic fiber. For example, reaction of cellulosic fibers with cellulosic reactive agents having the general formula (I) or (II), which both include a triazine ring, causes nitrogen content of fiber to be increased upon modification. The increase in nitrogen results mainly from the heterocyclically bonded nitrogen of the modified triazine ring, because the nitrogen content for an unmodified cellulose fiber material is very low, generally less than about 0.01 percent. Upon reaction with a water soluble cyanuric halide as described herein, the nitrogen content may be increased to greater than about 0.05 weight percent, and more preferably greater than about 0.1 weight percent, such as from about 0.1 to about 5 and still more preferably from about 0.3 to about 1 weight percent.

Webs that include the modified fibers can be prepared in any one of a variety of methods known in the web-forming art. In a particularly preferred embodiment modified fibers are incorporated into tissue webs formed by through-air drying and can be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

Fibrous tissue webs can generally be formed according to a variety of papermaking processes known in the art. For example, wet-pressed tissue webs may be prepared using methods known in the art and commonly referred to as couch forming, wherein two wet layers are independently formed and thereafter combined into a unitary web. To form the first web layer, fibers are prepared in a manner well known in the papermaking arts and delivered to the first stock chest, in which the fiber is kept in an aqueous suspension. A stock pump supplies the required amount of suspension to the suction side of the fan pump. Additional dilution water also is mixed with the fiber suspension.

To form the second web layer, fibers are prepared in a manner well known in the papermaking arts and delivered to the second stock chest, in which the fiber is kept in an aqueous suspension. A stock pump supplies the required amount of suspension to the suction side of the fan pump. Additional dilution water is also mixed with the fiber suspension. The entire mixture is then pressurized and delivered to a headbox. The aqueous suspension leaves the headbox and is deposited onto an endless papermaking fabric over the suction box. The suction box is under vacuum which draws water out of the suspension, thus forming the second wet web. In this example, the stock issuing from the headbox is referred to as the "dryer side" layer as that layer will be in eventual contact with the dryer surface. In some embodiments, it may be desired for a layer containing the synthetic and pulp fiber blend to be formed as the "dryer side" layer.

After initial formation of the first and second wet web layers, the two web layers are brought together in contacting relationship (couched) while at a consistency of from about 10 to about 30 percent. Whatever consistency is selected, it is typically desired that the consistencies of the two we webs be substantially the same. Couching is achieved by bringing the first wet web layer into contact with the second wet web layer at roll.

After the consolidated web has been transferred to the felt at the vacuum box, dewatering, drying and creping of the consolidated web is achieved in the conventional manner. More specifically, the couched web is further dewatered and transferred to a dryer (e.g., Yankee dryer) using a pressure roll, which serves to express water from the web, which is absorbed by the felt, and causes the web to adhere to the surface of the dryer.

The wet web is applied to the surface of the dryer by a press roll with an application force of, in one embodiment, about 200 pounds per square inch (psi). Following the pressing or dewatering step, the consistency of the web is typically at or above about 30 percent. Sufficient Yankee dryer steam power and hood drying capability are applied to this web to reach a final consistency of about 95 percent or greater, and particularly 97 percent or greater. The sheet or web temperature immediately preceding the creping blade, as measured, for example, by an infrared temperature sensor, is typically about 250° F. or higher. Besides using a Yankee dryer, it should also be understood that other drying methods, such as microwave or infrared heating methods, may be used in the present invention, either alone or in conjunction with a Yankee dryer.

At the Yankee dryer, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer is immediately following the creping doctor blade, permitting sufficient time for the spreading and drying of the film of fresh adhesive.

The creping composition may comprise anon-fibrous olefin polymer, as disclosed in U.S. Pat. No. 7,883,604, the contents of which are hereby incorporated by reference in a manner consistent with the present disclosure, which may be applied to the surface of the Yankee dryer as a water insoluble dispersion that modifies the surface of the tissue web with a thin, discontinuous polyolefin film. In particularly preferred embodiments the creping composition may comprise a film-forming composition and an olefin polymer comprising an interpolymer of ethylene and at least one comonomer comprising an alkene, such as 1-octene. The creping composition may also contain a dispersing agent, such as a carboxylic acid. Examples of particular dispersing agents, for instance, include fatty acids, such as oleic acid or stearic acid.

In one particular embodiment, the creping composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The olefin polymer composition may exhibit crystallinity of less than about 50 percent, such as less than about 20 percent. The olefin polymer may also have a melt index of less than about 1000 g/10 min, such as less than about 700 g/10 min. The olefin polymer may also have a relatively small particle size, such as from about 0.1 micron to about 5 microns when contained in an aqueous dispersion.

In an alternative embodiment, the creping composition may contain an ethylene-acrylic acid copolymer. The ethylene-acrylic acid copolymer may be present in the creping composition in combination with a dispersing agent.

The basis weight of tissue webs made in accordance with the present disclosure can vary depending upon the final product. For example, the process may be used to produce bath tissues, facial tissues, paper towels, and the like. In general, the basis weight of such fibrous products may vary from about 5 to about 110 gsm, such as from about 10 to about 90 gsm. For bath tissue and facial tissues products, for instance, the basis weight of the product may range from about 10 to about 40 gsm.

Likewise, tissue web basis weight may also vary, such as from about 5 to about 50 gsm, more preferably from about 10 to about 30 gsm and still more preferably from about 14 to about 20 gsm.

In multiple-ply products, the basis weight of each web present in the product can also vary. In general, the total basis weight of a multiple ply product will generally be from about 10 to about 100 gsm. Thus, the basis weight of each ply can be from about 10 to about 60 gsm, such as from about 20 to about 40 gsm.

Tissue webs and products produced according to the present disclosure also have good bulk characteristics, regardless of the method of manufacture. For instance, conventional wet pressed tissue prepared using modified fibers may have a sheet bulk greater than about 5 $cm^3/g$, such as from about 5 to about 15 $cm^3/g$ and more preferably from about 8 to about 10 $cm^3/g$. In other embodiments through-air dried tissue and more preferably uncreped through-air dried tissue comprising modified fibers have a sheet bulk greater than about 10 $cm^3/g$, such as from about 10 to about 20 $cm^3/g$ and more preferably from about 12 to about 15 $cm^3/g$.

In addition to varying the amount of modified fiber within the web, as well as the amount in any given layer, the physical properties of the web may be varied by specifically selecting particular layer(s) for incorporation of the modified fibers. For example, it has now been discovered that the greatest increase in bulk and softness, without significant decreases in tensile strength, may be achieved by forming a two layered tissue web where the modified fibers are selectively incorporated into the first layer and the second layer consists essentially of softwood kraft fibers.

In a particularly preferred embodiment, the present disclosure provides a tissue web having enhanced bulk and softness without a significant decrease in tensile, where the web comprises a first and a second fibrous layer, wherein the first fibrous layer comprises hardwood kraft fibers and modified fibers and the second fibrous layer comprises softwood kraft fibers, wherein the amount of modified fibers is from about 2 to about 80 percent by weight of the web. Preferably multi-layered webs having modified fibers selectively incorporated into the first fibrous layer have basis weights of at least about 15 gsm and geometric mean tensile strengths greater than about 300 g/3", such as from about 300 to about 1500 g/3".

While the web properties, such as tensile, bulk and softness may be varied by selectively incorporating modified fibers into a particular layer of a multi-layered web, the benefits of using modified fibers may also be achieved by blending modified fibers and wood fibers to form a blended tissue web. In particular, modified fibers may be blended with wood fibers to increase bulk and softness, compared to webs made from wood fibers alone. Such blended tissue webs comprise at least about 5 percent by weight of the web modified fiber, and more preferably at least 10 percent, such as from about 10 to about 50 percent, and have a geometric mean tensile strength greater than about 300 g/3" and more preferably greater than about 500 g/3", such as from about 500 to about 700 g/3".

In other embodiments the present disclosure provides a two-ply tissue product comprising an upper multi-layered tissue web and a lower multi-layered tissue web that are plied together using well-known techniques. The multi-layered webs comprise at least a first and a second layer, wherein modified fibers are selectively incorporated in only one of the layers, such that when the webs are plied together the layers containing the modified fibers are brought into contact with the user's skin in-use. For example, the two-ply tissue product may comprise a first and second tissue web, wherein the tissue webs each comprise a first and second layer. The first layer of each tissue web comprises wood fibers and modified fibers and, while the second layer of each tissue web is substantially free of modified fibers. When the tissue webs are plied together to form the tissue product the second layers of each web are arranged in a facing relationship such that the modified fibers are brought into contact with the user's skin in-use.

TEST METHODS

Tensile

Tensile testing was done in accordance with TAPPI test method T-576 "Tensile properties of towel and tissue products (using constant rate of elongation)" with the following modifications. More specifically, samples for dry tensile strength testing were prepared by cutting a 1±0.05 inch wide strip using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 5±0.04 inches. The crosshead speed was 0.5±0.004 inches/min and the break sensitivity was set at 70 percent. The sample was placed in the jaws of the instrument, centered both vertically and horizontally. The test was then started and ended when the specimen broke. Ten representative specimens were tested for each product or sheet and the arithmetic average of all individual specimen tests was recorded as the tensile strength the product or sheet in units of grams of force per inch of sample.

EXAMPLES

Modified wood pulps were prepared by mixing about 4 g of eucalyptus kraft pulp with a predetermined amount of the following cellulose reactive agents:

Reagent I

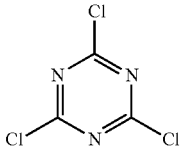

Reagent II

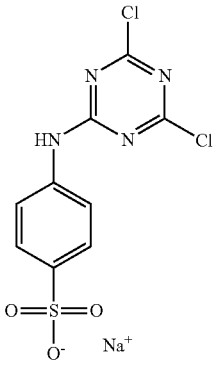

Reagent III

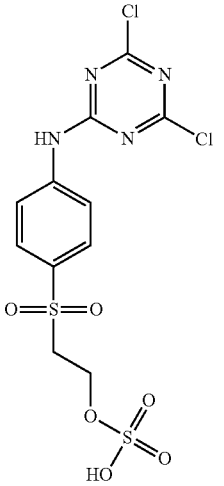

2-(4,6-dichloro-(1,3,5)-triazine-2 aminoyl) benzenesulfonic acid (Reagent II) is commercially available from Clariant International AG under the trade name Rayosan™ C Pa. The reaction conditions for each sample are set forth in Table 1, below. After reaction the pulp was washed three times with water at a pulp consistency of about 2 percent.

TABLE 1

| Sample No. | Pulp (g) | Reagent (g) | NaOH (g) | Solvent | Solvent (L) | Temp (° C.) | Reaction Time (hr) |
|---|---|---|---|---|---|---|---|
| 1 | 300 | I (15.1) | 21.0 | Acetone | 11 | 15 | 2 |
| 2 | 18,600 | II (4,000) | 2,500 | Water | 91 | 20 | 12 |
| 3 | 92.0 | III (13.8) | 6.4 | Water | 0.5 | 70 | 1 |

Handsheets were prepared using a Valley Ironwork lab handsheet former measuring 8.5 inches×8.5 inches. The pulp (either treated or control) was mixed with distilled water to form slurries at a ratio of 25 g pulp (on dry basis) to 2 L of water. The pulp/water mixture was subjected to disintegration using an L&W disintegrator Type 965583 for 5 minutes at a speed of 2975±25 RPM. After disintegration the mixture was further diluted by adding 4 L of water. Handsheets having a basis weight of 60 grams per square meter (gsm) were formed using the wet laying handsheet former. Handsheets were couched off the screen, placed in the press with blotter sheets, and pressed at a pressure of 75 pounds per square inch for one minute, dried over a steam dryer for two minutes, and finally dried in an oven. The handsheets were cut to 7.5 inches square and subject to testing. The results of the testing are summarized in Table 2, below.

TABLE 2

| Sample No. | Caliper (mils) | Sheet Bulk (cc/g) | Tensile (gf) |
|---|---|---|---|
| Control | 6.50 | 2.752 | 2359 |
| 1 | 14.1 | 5.969 | 236 |
| 2 | 14.9 | 6.308 | 261 |
| 3 | 15.6 | 6.604 | 149 |

We claim:

1. A method of increasing the bulk of a tissue web comprising the steps of treating the cellulosic fiber with a caustic agent to yield a caustic treated cellulosic fiber; reacting caustic treated cellulosic fiber at a pH greater than about 9 with a water soluble cellulosic reactive reagent selected from the group consisting of reagents having the general Formula (I) and (II) to yield a treated cellulosic fiber; washing the treated cellulosic fiber; and forming a tissue web from the treated cellulosic fiber, wherein the tissue web has a basis weight greater than about 10 grams per square meter (gsm) and a sheet bulk greater than about 5 cc/g.

2. The method of claim 1 wherein the caustic agent is selected from the group consisting of hydroxide salts, carbonate salts and alkaline phosphate salts.

3. The method of claim 1 wherein the water soluble cellulosic reactive agent is 2-(4,6-dichloro-(1,3,5)-triazine-2 aminoyl) benzenesulfonic acid.

4. The method of claim 1 wherein the step of reacting cellulosic fiber with a cellulosic reactive reagent is carried out at a fiber consistency from about 5 to about 30 percent solids.

5. The method of claim 1 wherein the weight ratio of cellulosic fiber to cellulosic reactive reagent is from about 5:0.1 to about 5:1.

6. The method of claim 1 wherein the step of reacting cellulosic fiber and a cellulosic reactive reagent is carried out at a pH from about 9 to about 10 and at a temperature from about 0 to about 70° C.

7. The method of claim 1 wherein the cellulose fiber is either bleached northern softwood kraft pulp or bleached eucalyptus kraft pulp.

8. The method of claim 1 wherein the washed cellulosic fiber has a nitrogen content of at least about 0.2 weight percent.

9. A method of forming a tissue product comprising the steps of:

a. treating cellulosic fiber with a caustic agent to yield a caustic treated cellulosic fiber;

b. reacting the caustic treated cellulosic fiber with a water soluble cellulosic reactive reagent selected from the group consisting of regents having the general Formula (I) and (II) at a pH greater than about 9 to yield a treated cellulosic fiber;

c. washing the treated cellulosic fiber; and d. forming a multi-layered tissue web by depositing the treated cellulosic fiber between adjacent layers of untreated cellulosic fiber;

e. combining two or more multi-layered tissue webs to form a tissue product.

10. The method of claim 9 wherein the caustic agent is selected from the group consisting of hydroxide salts, carbonate salts and alkaline phosphate salts.

11. The method of claim 9 wherein the water soluble cellulosic reactive agent is 2-(4,6-dichloro-(1,3,5)-triazine-2 aminoyl) benzenesulfonic acid.

12. The method of claim 9 wherein the step of reacting cellulosic fiber and a cellulosic reactive reagent is carried out at a fiber consistency from about 5 to about 30 percent solids.

13. The method of claim 9 further comprising the step of creping the multi-layered tissue web.

14. The method of claim 9 wherein the tissue product has a basis weight from about 14 to about 20 grams per square meter (gsm).

15. The method of claim 9 wherein the tissue product has a geometric mean tensile (GMT) from about 500 to about 800 g/3" and a sheet bulk greater than about 10 cc/g.

16. The method of claim 9 wherein the weight ratio of cellulosic fiber to cellulosic reactive reagent is from about 5:0.1 to about 5:1.

17. The method of claim 9 wherein the step of reacting cellulosic fiber and a cellulosic reactive reagent is carried out at a pH from about 9 to about 10 and at a temperature from about 0 to about 70° C.

18. The method of claim 9 wherein the cellulose fiber is either bleached northern softwood kraft pulp or bleached eucalyptus kraft pulp.

19. The method of claim 9 wherein the washed cellulosic fiber has a nitrogen content of at least about 0.2 weight percent.

20. A method of increasing the bulk of a tissue web comprising the steps of:

a. treating the cellulosic fiber with a caustic agent to yield a caustic treated cellulosic fiber;

b. reacting caustic treated cellulosic fiber with 2-(4,6-dichloro-(1,3,5)-triazine-2 aminoyl) benzenesulfonic acid to yield a treated cellulosic fiber;

c. washing the treated cellulosic fiber; and d. forming a tissue web from the treated cellulosic fiber, wherein the tissue web has a basis weight greater than about 10 grams per square meter (gsm) and a sheet bulk greater than about 5 cc/g.

* * * * *